US008785761B2

(12) United States Patent
Tabata

(10) Patent No.: US 8,785,761 B2
(45) Date of Patent: Jul. 22, 2014

(54) SOUND-GENERATION CONTROLLING APPARATUS, A METHOD OF CONTROLLING THE SOUND-GENERATION CONTROLLING APPARATUS, AND A PROGRAM RECORDING MEDIUM

(71) Applicant: Casio Computer Co., Ltd., Tokyo (JP)

(72) Inventor: Yuji Tabata, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 3 days.

(21) Appl. No.: 13/845,025

(22) Filed: Mar. 17, 2013

(65) Prior Publication Data

US 2013/0239789 A1 Sep. 19, 2013

(30) Foreign Application Priority Data

Mar. 19, 2012 (JP) ..... 2012-062738

(51) Int. Cl.
*G10H 1/46* (2006.01)
*G10H 3/00* (2006.01)

(52) U.S. Cl.
USPC ..... 84/741

(58) Field of Classification Search
USPC ..... 84/736–742, 746
See application file for complete search history.

(56) References Cited

U.S. PATENT DOCUMENTS

| | | | | |
|---|---|---|---|---|
| 3,530,224 | A * | 9/1970 | Kushner et al. | 84/742 |
| 7,943,843 | B2 * | 5/2011 | Komatsu | 84/615 |
| 8,084,681 | B2 * | 12/2011 | Schon | 84/746 |
| 2009/0205476 | A1 * | 8/2009 | Komatsu | 84/17 |
| 2011/0271820 | A1 * | 11/2011 | Cockerell et al. | 84/746 |

FOREIGN PATENT DOCUMENTS

JP 2002-182643 A 6/2002

* cited by examiner

*Primary Examiner* — Jeffrey Donels
(74) *Attorney, Agent, or Firm* — Holtz Holtz Goodman & Chick PC

(57) ABSTRACT

An electronic drum set is provided, which allows a user to give a performance, feeling as if the user is playing acoustic drums. The electronic drum set DS is provided with a foot board, a potentiometer, and CPU. The foot board is pressed down by the user. When the user presses the foot board down, the potentiometer mounted on the foot board obtains an angular rate and angular acceleration of the foot board. CPU determines based on the obtained angular acceleration, a timing, at which an instruction of generating a musical tone is given. Further, CPU controls based on the obtained angular rate, a generating state of a musical tone, the generation of which is instructed.

7 Claims, 7 Drawing Sheets

SOUND-GENERATION CONTROLLING APPARATUS, A METHOD OF CONTROLLING THE SOUND-GENERATION CONTROLLING APPARATUS, AND A PROGRAM RECORDING MEDIUM

CROSS-REFERENCE TO RELATED APPLICATION

The present application is based upon and claims the benefit of priority from the prior Japanese Patent Application No. 2012-062738, filed Mar. 19, 2012, the entire contents of which are incorporated herein by reference.

BACKGROUND OF THE INVENTION

1. Field of the Invention

The present invention relates to a sound-generation controlling apparatus, a method of controlling the sound-generation controlling apparatus, and a program recording medium, which allow a user to give a performance, feeling as if he or she is playing acoustic drums.

2. Description of the Related Art

In the past, foot pedals were used for playing bass drums composing an acoustic drum set. When the foot pedal is pressed down by a player, a beater of the foot pedal strikes the bass drums to generate sounds.

A drum set (hereinafter, referred to as the "electronic drum set") assembled as an electronic musical instrument is constructed such that an instruction of generating a sound of the bass drum is given when a foot pedal device is pressed down by the player in a manner similar to the player's motion of pressing down the foot pedal device of the acoustic drum set. The electronic drum set provided with the foot pedal device of the above type is disclosed by Japanese Unexamined Patent Publication No. 2002-182643.

But, even if played in the manner similar to the player's playing the acoustic drum set, the electronic drum set disclosed by Japanese Unexamined Patent Publication No. 2002-182643 does not generate sounds at the same timings as the acoustic drum set generates the sounds. Therefore, this disadvantage involved in the electronic drum set invites a problem that does not allow the player to play the electronic drum set with a feeling of playing the acoustic drum set.

The foot pedal described in Japanese Unexamined Patent Publication No. 2002-182643 is simply composed of a collection of switches. Therefore, when pressed down to a predetermined amount, the switch of the foot pedal is made to turn on to generate a sound. But the foot pedal of the acoustic drum set does not generate a sound as far as it is not pressed down at a rate more rapid than a predetermined rate regardless of the pressed-down amount. The electronic drum set disclosed in Japanese Unexamined Patent Publication No. 2002-182643 has the disadvantage described above and does not allow the player to give the performance with a feeling of playing the acoustic drum set.

SUMMARY OF THE INVENTION

The present invention has been made to solve the disadvantage involved in the conventional technique and provides a sound-generation controlling apparatus, a method of controlling the sound-generation controlling apparatus, and a program recording medium, which allow a user to give a performance, feeling as if he or she is playing acoustic drums.

According to one aspect of the present invention, there is provided a sound-generation controlling apparatus, which comprises a pedal to be pressed down by a user, an angular data obtaining unit provided on the pedal, for obtaining an angular rate and angular acceleration of the pedal caused when the pedal has been pressed down by the user, a sound-generation instructing unit for determining a timing, at which an instruction of generating a musical tone is given, based on the angular acceleration of the pedal obtained by the angular data obtaining unit, and a sound-generation controlling unit for controlling a generating state of a musical tone, the generation of which is instructed by the sound-generation instructing unit, based on the angular rate of the pedal obtained by the angular data obtaining unit.

Using the sound-generation controlling apparatus of the invention, the player can give a performance with a feeling as if he or she is playing the acoustic drum set.

DETAILED DESCRIPTION OF THE PREFERRED EMBODIMENTS

Now, the embodiments of the present invention will be described with reference to the accompanying drawings in detail.

Figure 1:
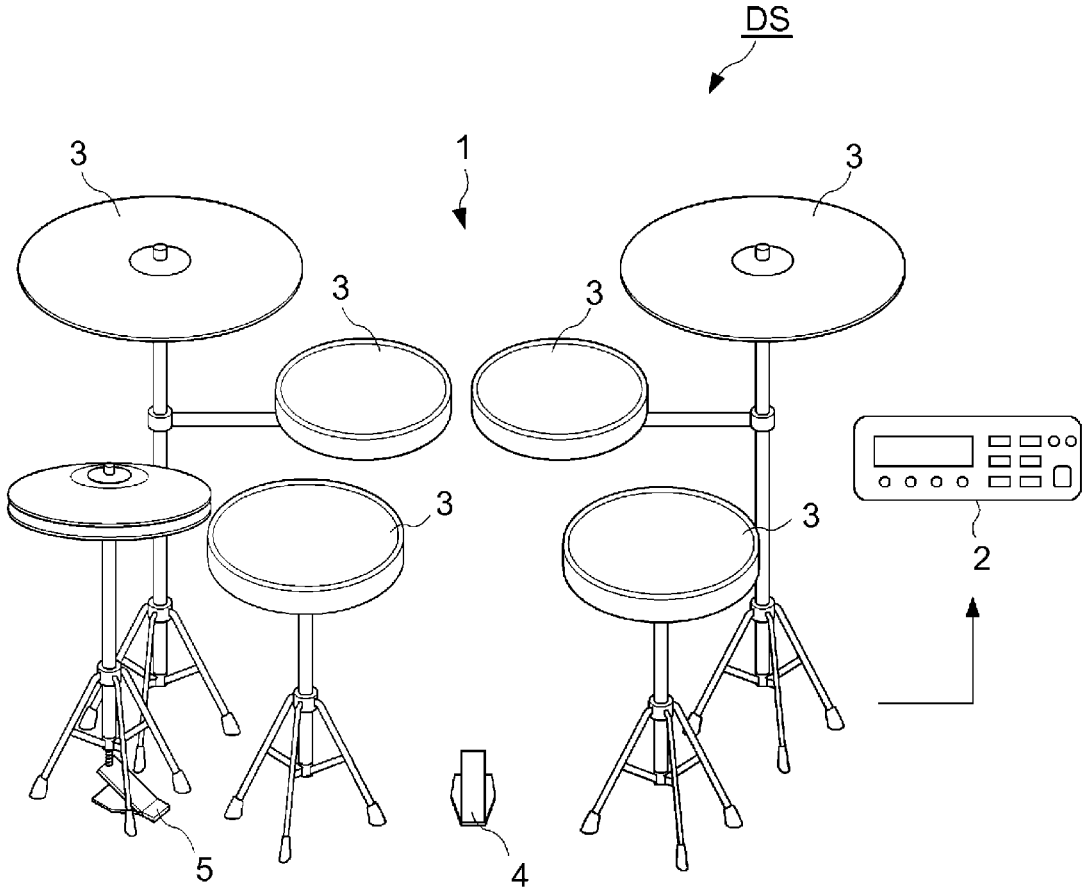
FIG. 1 is a schematic view of an electronic drum set according to the embodiment of the present invention.

FIG. 1 is a schematic view of an electronic drum set. The electronic drum set is provided with foot pedal devices and a sound source unit according to an embodiment of a sound generation controlling apparatus of the present invention.

As shown in FIG. 1, the electronic drum set DS comprises a trigger unit 1 and a sound source unit 2. The trigger unit 1 outputs trigger-information of triggering a sound generation and the sound source unit 2 generates a sound upon receipt of the trigger-information.

The trigger unit 1 is composed of various sorts of pads 3, a foot pedal device 4, and a hi-hat pedal device 5.

The pads 3 have similar shapes to drums (bass drum, floor toms, snare drum and toms) and cymbals (hi-hats, classic cymbal, and a ride cymbal) in the acoustic drum set, and can be played substantially in the same manner as the acoustic drums. These pads 3 are connected to the sound source unit 2. When a player has struck the pad 3 with a drum stick, the pad 3 generates a mechanical oscillation in its pad and a sensor converts the mechanical oscillation into information (hereinafter, referred to as the "oscillation information") of an electronic oscillation, supplying the oscillation information to the sound source unit 2.

That is, the electronic drum set DS is constructed so as to output a sound of the struck pad from the sound source unit 2, when the player has struck the pad with the drum stick.

The foot pedal device 4 has a similar shape to the foot pedal, and can be played substantially in the same manner as the acoustic drum. When the player has pressed the foot pedal device 4 down, the foot pedal device 4 outputs to the sound source unit 2 information of an angle (hereinafter, referred to as the "angular information") representing a moving distance, by which the food pedal of the food pedal device 4 moves or travels, when the food pedal is pressed down by the player. The sound source unit 2 obtains an angular rate and angular acceleration from the received angular information, and determines whether a sound should be generated and/or at what loudness level (velocity) the sound should be generated, based on the angular rate and angular acceleration. The detail of the food pedal device 4 will be described later.

The hi-hat pedal device 5 has a shape similar to the hi-hat pedal, and can be played substantially in the same manner as the acoustic drum. When the player has pressed the hi-hat pedal device 5 down, the hi-hat pedal device 5 outputs to the sound source unit 2 information of an angle (hereinafter, referred to as the "angular information") representing a moving distance, by which the hi-hat pedal of the hi-hat pedal device 5 moves or travels, when the hi-hat pedal is pressed down by the player. The sound source unit 2 obtains an angular rate and angular acceleration from the angular information, and determines whether a sound should be generated and/or at what loudness level (velocity) the sound should be generated, based on the angular rate and angular acceleration. Based on the angular information, the sound source unit 2 determines a tone color of a sound, which is generated at the time when the player has struck the hi-hat cymbal with the drum stick.

The sound source unit 2 performs various processes relating to the sound generation, based on performance-information (oscillation information and angular information) supplied from the trigger unit 1, which has been operated by the player. In the present embodiment of the invention, the sound source unit 2 outputs sounds through a mounted speaker (not shown) in addition to performing the various processes relating the sound generation. The functional configuration of the sound source unit 2 will be described later.

The construction and operation of the foot pedal device 4 will be described. The foot pedal device 4 according to the present embodiment is a simplified foot pedal device with the beater removed. The beater is usually used for playing the bass drum in the acoustic drum kit.

Figure 2A:
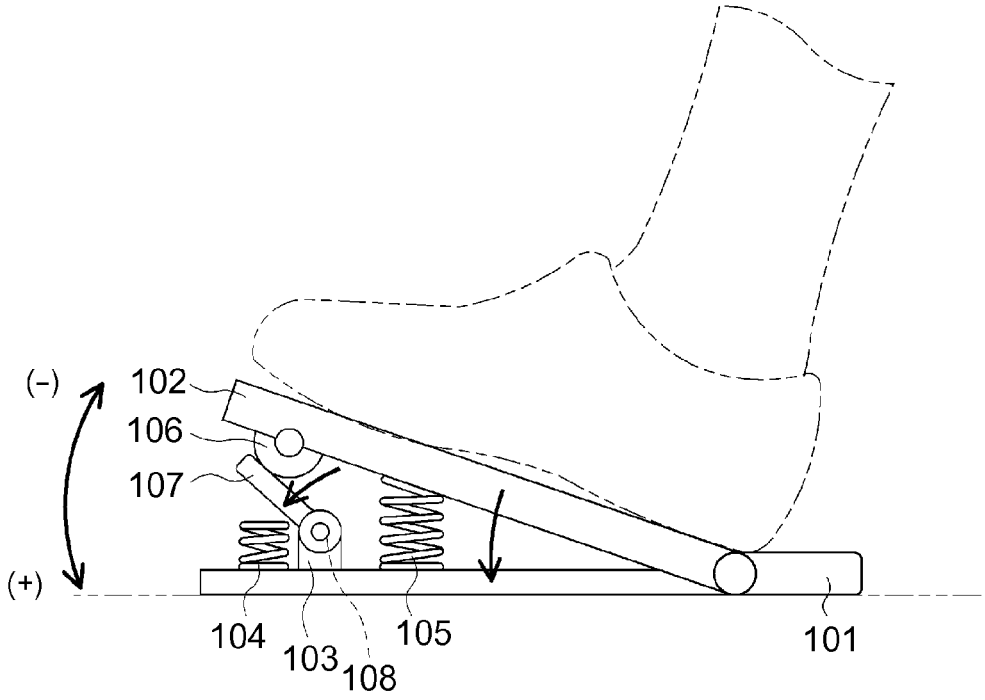
FIG. 2A is a schematic view showing a foot pedal device, which is kept out of operation in the embodiment of the invention.

FIG. 2A is a schematic view showing an example of the foot pedal device 4, which is out of operation in the present embodiment of the invention.

Figure 2B:
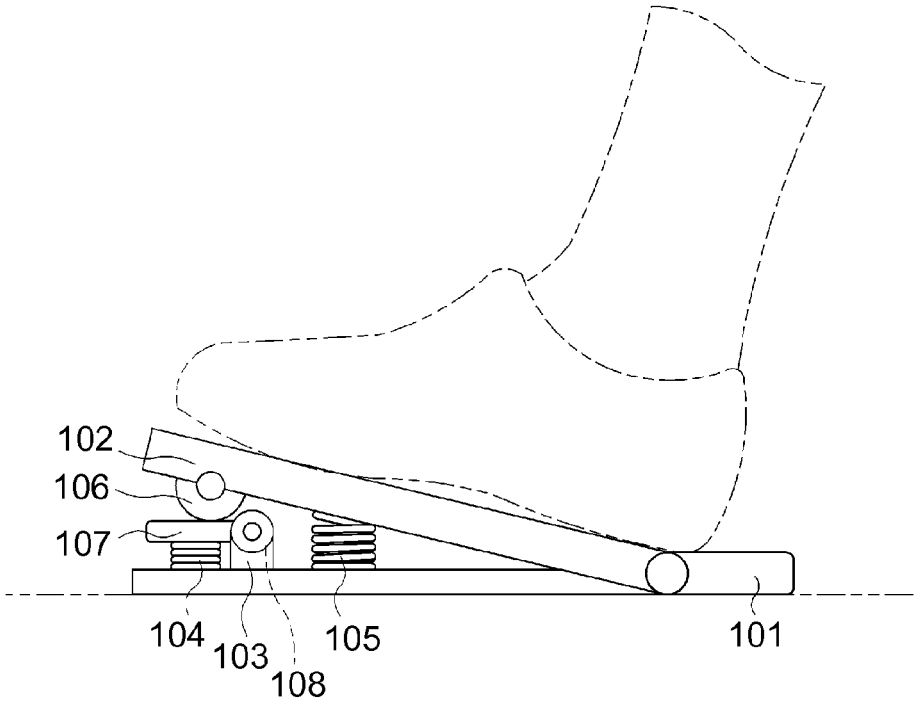
FIG. 2B is a schematic view showing the foot pedal device in operated state in the embodiment of the invention.

FIG. 2B is a schematic view showing an example of the foot pedal device 4, which is in a pressed-down state in the present embodiment of the invention.

As shown in FIG. 2A, the foot pedal device 4 consists of an under plate 101, a foot board 102, on which the player puts his or her foot to press down, a mechanical part 103 provided between the under plate 101 and the foot board 102, a dumping spring 104 provided o the under plate 102 and serving as a dumping member for a mechanical part 107 to be described later, and a foot-board spring 105 provided between the foot board 102 and the under plate 101.

The under plate 101 is a plate member, which is provided at the position of the grounding face of the foot pedal device 4.

The foot board 102 is a member to be pressed down by the player, and is provided with a mechanism, which is in contact with the mechanical part 103 to transfer the player's motion of pressing the foot board 102 down. The foot board 102 is supported on the under plate 101 by means of an axle and turns in the plus (+) direction when pressed down, and also turns in the minus (−) direction when released, as shown in FIG. 2A. The foot board 102 is always urged in the minus (−) direction under influence of the foot-board spring 105.

The foot board 102 is also provided with a mechanical part 106 including a roller member to reduce friction between the foot board 102 and the mechanical part 103.

The mechanical part 103 is mounted on the under plate 101 and has a mechanical part 107 and a potentiometer 108.

The mechanical part 107 is mounted on the mechanical part 103 by means of an axle, and turns in the plus (+) direction and/or in the minus (−) direction (refer to FIG. 2A).

The potentiometer 108 is a position detecting device of a rotary type, having a built-in torsion spring. The potentiometer 108 is provided on the mechanical part 103 mounted on the under plate 101 and detects a rotation angle representing the player's motion of pressing the foot board 102 down through the mechanical parts 107 and 106.

In the embodiment of the invention, it is presumed that when the player presses the foot board 102 down, the foot board 102 turns in the plus (+) direction and the rotation angle of the player's motion appears in the plus (+) direction (refer to FIG. 2A), and when the player releases the foot board 102, the foot board 102 turns in the minus (−) direction, and the rotation angle of the player's motion appears in the plus (−) direction (refer to FIG. 2A).

The built-in torsion spring of the potentiometer 108 is always urged in the minus (−) direction to keep both the mechanical part 107 and the mechanical part 106 of the foot board 102 in contact with each other at all times.

In the foot pedal device 4 described above, when the player presses the foot board 102 down, the foot board 102 and the mechanical part 107 move toward their pressed-down positions shown in FIG. 2B from their original positions shown in FIG. 2A. On the contrary, when the player releases the foot board 102 from the pressed-down position (FIG. 2B), the foot board 102 and the mechanical part 107 return respectively to their original positions or released positions shown in FIG. 2A from their pressed-down positions shown in FIG. 2B. In other words, when the foot board 102 is pressed down, the foot board 102 and the mechanical part 107 move in the plus (+) direction, and when the foot board 102 is released, the foot board 102 and the mechanical part 107 return in the minus (−) direction under the influence of the built-in torsion spring of the potentiometer 108.

More specifically, in the foot pedal device 4 kept in the state (released position) as shown in FIG. 2A, when player's pressing-down force is applied to the foot-board 102 against the influence of the built-in torsion spring of the potentiometer 108 and the influence of the foot-board spring 105, the foot board 102 moves in the plus (+) direction. And when the foot board 102 moves in the plus (+) direction, the mechanical part 106 comes in contact with the mechanical part 107, moving the mechanical part 107 so as to follow the movement of the foot board 102 in the plus (+) direction. Accordingly, the foot board 102 and the mechanical part 107 of the foot pedal device 4 move from the original positions (shown in FIG. 2A) to the pressed-down positions (shown in FIG. 2B), respectively. At this time, the potentiometer 108 detects the movement of the foot board 102 and the mechanical part 107, that is, the potentiometer 108 detects changes in their positions and supplies the sound source unit 2 with the detected changes in position as the angular information.

On the contrary, when the player's pressing-down force is removed from the foot board 102 to release said foot board 102 from the pressed-down position (shown in FIG. 2B), the foot board 102 moves in the minus (−) direction toward the original position (shown in FIG. 2A) under the influence of the built-in torsion spring of the potentiometer 108 and the influence of the foot-board spring 105. The potentiometer 108 detects the movement of the foot board 102, that is, the potentiometer 108 detects a change in the position of the foot board 102 and supplies the sound source unit 2 with the detected change in position of the foot board 102 as the angular information.

As described above, the potentiometer 108 detects the change in the position of the foot board 102 through the mechanical part 107 to obtain the angular information, thereby detecting the player's pressing-down motion. In the foot pedal device 4 according to the present embodiment, the potentiometer 108 detects the change in the position of the mechanical part 107 at predetermined intervals to obtain the angular information representing an amount of movement of the mechanical part 107. It is possible to calculate a rotation angle of the mechanical part 107 from the obtained amount of movement in a unit of time, an angular rate of the mechanical part 107 from a change rate of the movement amount of the mechanical part 107, and an angular acceleration of the mechanical part 107 from a change rate of the angular rate of the mechanical part 107. The calculated rotation angle, angular rate, and angular acceleration of the mechanical part 107 structurally correlate with the rotation angle, angular rate, and angular acceleration of the foot board 102, respectively. Therefore, a pressing-down force applied to the foot board 102, a pressing-down speed and pressing-down depth of the foot board 102 can be driven from the result of the calculation.

As described above, in the foot pedal device 4, when the pressing-down force and the pressing-down speed are correlated with the player's motion of playing the foot pedal of a beater type, such pressing-down force and pressing-down speed can be reflected in a loudness level (velocity) of a sound in consideration of the structural features of the foot pedal.

The foot pedal device 4 having the above described construction is combined with the sound source unit 2, allowing the player to enjoy the feeling of playing the bass drum of the acoustic drum.

The foot pedal is an operator of the acoustic drum, and converts the player's motion of pressing the foot board 102 down into a rotation motion of the beater, thereby making the rotating beater to strike the bass drum and generating sounds of the bass drum. The player uses the foot pedal to play the bass drum.

In playing the bass drum with the foot pedal, even if the player does not press the foot board 102 down until the beater strikes the surface of the bass drum, the beater can strike the bass drum to generate a sound with aid of the inertial force due to its own gravitational force, when the player has strongly pressed the foot board down. The player uses the above feature of the foot pedal to play the bass drum. Further, the player plays the bass drum at an up-tempo using the above feature of the foot pedal.

In the sound-generation controlling apparatus of the present invention, that is, in the electronic drum set DS (foot pedal device 4 and sound source unit 2), information is detected, reflecting the player's force to press the foot board 102 down, the pressing-down speed and depth (travel distance) of the foot board 102, and the sound source unit 2 operates so as to reflect the detected information, whereby a drum performance leveraging the above features of the foot pedal device 4 can be given.

In the foot pedal device 4 of the present invention, since the mechanical part 106 is always kept in contact with the mechanical part 107 and the mechanical part 107 moves together with the movement of the foot board 102 in response to the player's pressing down motion, little mechanical noises are generated due a mechanical contact between the mechanical part 106 and the mechanical part 107, and a higher level of silence is obtained, compared with a foot pedal, which detects an instruction of a sound generation based on a switching operation of contact points provided both on the foot board 102 and the under plate 101.

Now, the configuration of the hardware of the sound source unit 2 will be described. The sound source unit 2 is able to generate sounds based on the information output from the trigger unit 1 including the foot pedal device 4.

Figure 3:
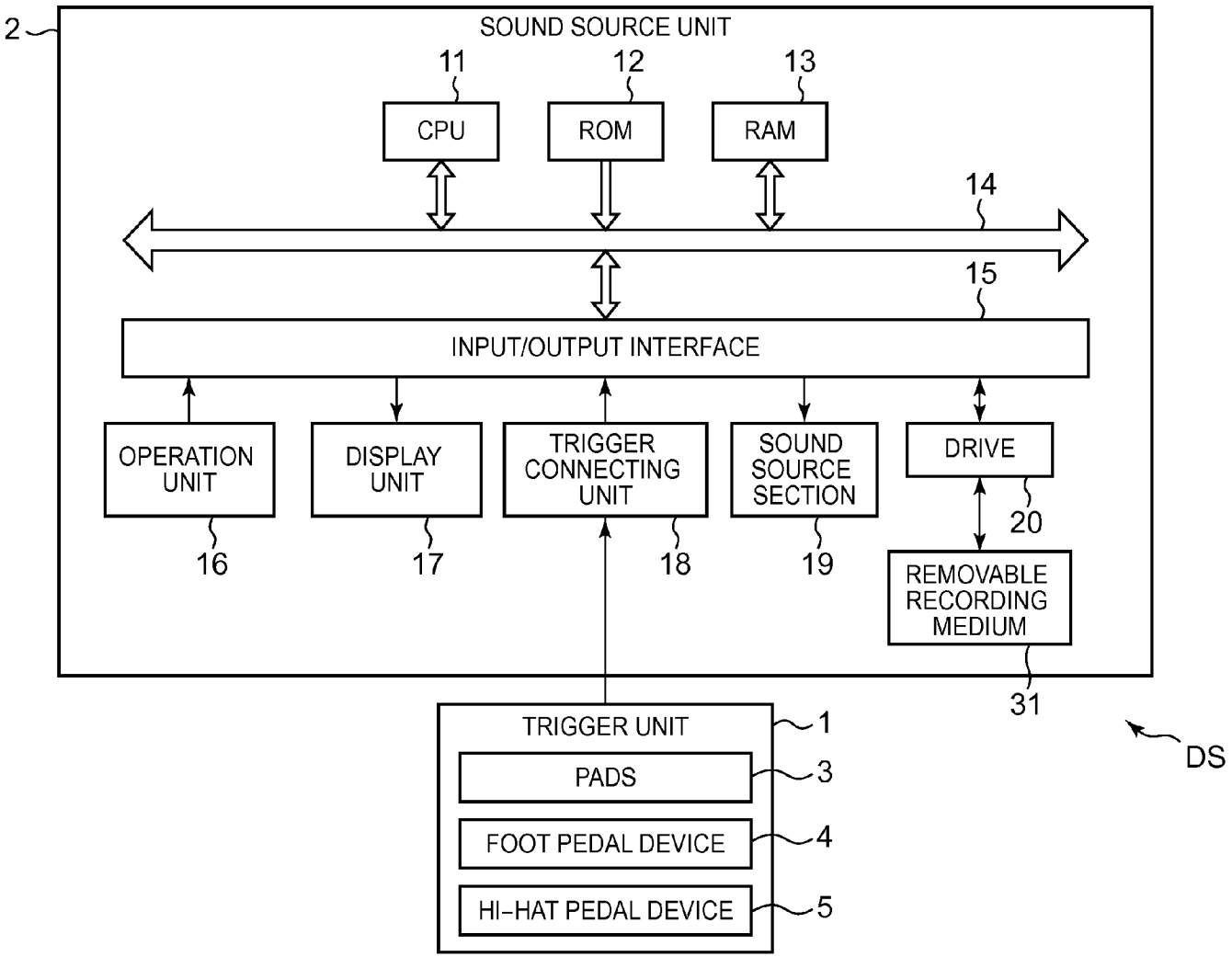
FIG. 3 is a block diagram showing a configuration of hardware of a sound source unit according to the embodiment of the invention.

FIG. 3 is a block diagram showing the configuration of the hardware of the sound source unit 2 according to the embodiment of the invention.

The sound source unit 2 comprises CPU (Central Processing Unit) 11, ROM (Read Only Memory) 12, RAM (Random Access Memory) 13, a bus 14, an input/output interface 15, an operation unit 16, a displaying unit 17, a trigger connecting unit 18, a sound source section 19 and a drive 20.

CPU 11 reads a program stored in ROM 12 and a program loaded on RAM 13 to perform various processes.

RAM 13 serves to store data, which is necessary for CPU 11 to perform the various processes.

More specifically, RAM 13 stores information of a triggering process, FP (Foot Pedal) controlling information, HH (Hi-Hat) controlling information, information of operation and display, and sound-source controlling information.

The information of a triggering process (triggering-process information) is used to determine whether a sound of the struck pad should be generated and at what loudness level (velocity) the sound should be generated, based on oscillation information, wherein the oscillation information is generated at the time when the player has struck with the drum stick various pads for the floor toms, snare drum, toms, classic cymbal, and the ride cymbal.

The FP (Foot Pedal) controlling information is used to determine whether a sound should be generated and/or at what loudness level (velocity) the sound should be generated, based on an angular rate and angular acceleration, wherein the angular rate and angular acceleration are obtained from information (hereinafter, referred to as the "angular information") representing an angle of the foot board 102 made when the player has pressed down the foot board 102 of the foot pedal device 4 for the pad of the bass drum.

The HH (Hi-Hat) controlling information is used to determine whether a sound should be generated and/or at what loudness level (velocity) the sound should be generated, based on an angular rate and angular acceleration, wherein the angular rate and angular acceleration are obtained from information (angular information) representing the angle of the foot board 102 made when the player has pressed down the foot board 102 of the foot pedal device 4 for the pad of the hi-hat.

The information of operation and display (operation/display information) relates to various operations and displaying operations.

The sound-source controlling information is used to output a sound through the speaker based on the sound determined to be generated and at the determined loudness level (velocity) of the sound to be generated.

To process the above information stored in RAM 13, the following programs are expanded on ROM 12: a program relating to a triggering-process for processing the triggering-process information; a program relating to a FP controlling process (sound-generation information producing process)

for processing the FP controlling information; a program relating to a HH controlling process for processing the HH controlling information; a program relating to an operation and displaying process for processing the information of operation and display; and a program relating to a sound-source controlling process for processing the sound-source controlling information. In other words, CPU 11 performs these processes (the triggering-process, FP controlling process, HH controlling process, operation and displaying process, and the sound-source controlling process) to process the above information (the triggering-process information, FP controlling information, HH controlling information, information of operation and display, and the sound-source controlling information). As a result, the display unit 17 and the sound source section 19 in the sound source unit 2 output images and sounds through the operation unit 16 and the trigger connecting unit 18.

CPU 11 is connected with ROM 12 and RAM 13 through the bus 14. The input/output interface 15 is also connected to the bus 14. To the input/output interface 15 are connected the operation unit 16, displaying unit 17, trigger connecting unit 18, sound source section 19 and the drive 20.

The operation unit 16 consists of various buttons, and is used by the user to input various sorts of information.

The displaying unit 17 comprises a displaying device for displaying images.

The trigger connecting unit 18 is an interface, which can be connected with a trigger unit 1 in conformity with an intended standard. The sound source unit 2 receives the oscillation information from the pads 3 and the angular information from the foot pedal device 4 through the trigger connecting unit 18.

The sound source section 19 comprises a sound source, DSP (Digital Signal Processor), an amplifier, and a speaker. The sound source section 19 converts musical-tone data into an analog signal, thereby outputting an audio signal through the speaker, wherein the musical-tone data is produced from waveform data (drum sound generating data in the present embodiment).

The drive 20 is a device, which receives a removable recording medium 31 such as a magnetic disk, an optical disk, a magneto optical disk, and a semi-conductor dusk. The drive 20 reads a program from the removable recording medium 31 and the program is installed on RAM 13 as needed. Various sorts of data such as image data, stored in the removable recording medium 31 can be also stored in RAM 13.

A performance process to be executed by the sound source unit 2 will be described in detail.

Figure 4:
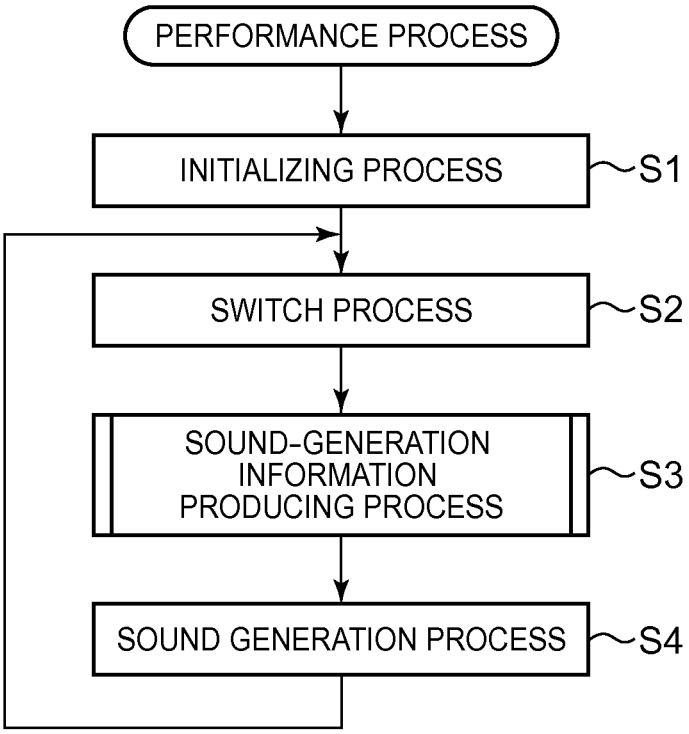
FIG. 4 is a flow chart of a performance process performed by the sound source unit shown in FIG. 3.

FIG. 4 is a flow chart of the performance process executed by the sound source unit 2 shown in FIG. 3.

The performance process is executed for producing information relating to a sound generation (sound-generation information) in response to the player's operation of the operation unit 16 and for outputting a sound from the sound source section 19 based on the produced sound-generation information. When the player operates the operation unit 16 to give an instruction of starting the performance process, then the performance process starts and the following processes are performed.

In the description of the flowchart of FIG. 4, the process will be described, which is performed, when the player has operated the foot pedal device 4 included in the trigger unit 1, that is, when the player has played the bass drum. The process is not described, which will be executed, when the pad 3 other than the foot pedal 4 is operated.

CPU 11 of the sound source unit 2 performs an initializing process (step S1). In other words, CPU 11 initializes the sound source unit 2.

CPU 11 performs a switch process (step S2). In the switch process, the player is allowed to operate the operation unit 16 to choose one operation mode from among plural operation modes and/or to change the tone color of the sound to be generated.

CPU 11 performs a sound-generation information producing process (step S3). In the sound-generation information producing process, CPU 11 obtains the angular information from the foot pedal device 4, and further obtains the angular rate and angular acceleration from the obtained angular information. Then, CPU 11 determines, whether a sound should be generated and at what loudness level (velocity) the sound should be generated, based on the obtained angular rate and angular acceleration, thereby producing sound-generation information. The sound-generation information producing process will be described in detail later.

Further, CPU 11 performs a sound generation process (step S4). In the sound generation process, CPU 11 generates a sound from the sound source section 19 based on the sound-generation information. As described above, the sound source unit 2 controls the operation of the sound source section 19 based on the sound-generation information produced at step S3 to generate a sound in response to the player's operation performed on the foot pedal device 4.

The sound-generation information producing process to be performed by the sound source unit 2 will be described in detail.

Figure 5:
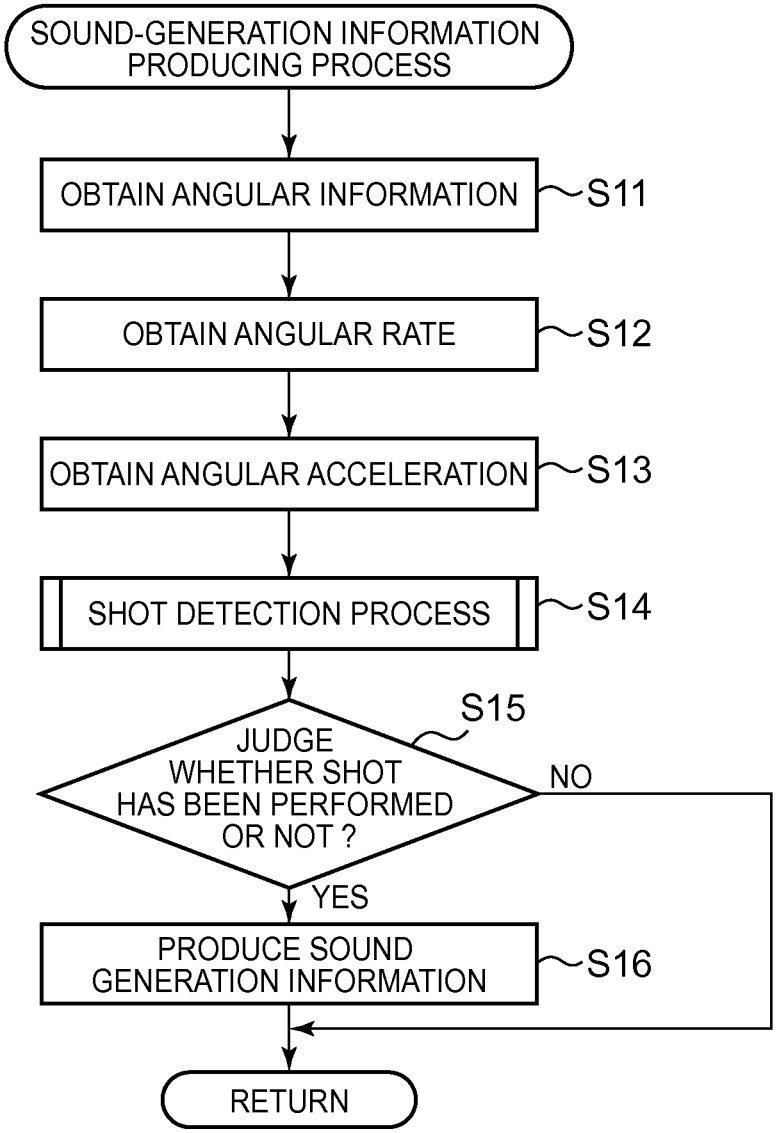
FIG. 5 is a flow chart of an example of a sound-generation information producing process performed by the sound source unit shown in FIG. 3.

FIG. 5 is a flow chart of an example of the sound-generation information producing process performed by the sound source unit 2 shown in FIG. 3. In the sound-generation information producing process, CPU 11 detects a moving distance, which the foot pedal device 4 moves when pressed down by the player, from information of the player's motion of pressing the foot pedal device 4 down, and produces the sound-generation information based on the detected moving distance of the foot pedal device 4.

CPU 11 obtains the angular information from the foot pedal device 4 (step S11).

CPU 11 executes first derivation on the angular information (angle of the foot board 102) to obtain the angular rate of the foot board 102 (step S12).

Further, CPU 11 executes second derivation on the angular information (angle of the foot board 102) to obtain the angular acceleration of the foot board 102 (step S13).

CPU 11 performs a shot detecting process (step S14). Hereinafter, the "shot" means the player's pressing-down operation of the foot pedal device 4 to the extent that a sound is generated.

In the shot detecting process, when the foot board 102 is released to move in the minus (−) direction (shown in FIG. 2A), the angular information is set to "OPEN=0" and when the foot board 102 is pressed down to move in the plus (+) direction (shown in FIG. 2A), the angular information is set to "CLOSE>0".

In the shot detecting process, CPU 11 detects from the angular information a point at which the angular rate changes the direction from the plus (+) direction to the minus (−) direction, thereby detecting the player's releasing motion performed after the pressing-down motion of the foot board 102.

In the shot detecting process, CPU 11 detects the releasing motion of the foot board 102 based on the angular acceleration generated when the foot board 102 has been pressed down, setting the detected releasing motion as the trigger of the shot. Further, CPU 11 detects force of the shot based on the angular rate generated when the foot board 102 has been pressed down and adjusts the timing of the sound generation based on the angular rate and angular acceleration generated when the foot board 102 has been pressed down, whereby a sound can be generated in response to the player's "shot", even if the foot board 102 has not been pressed to the floor or to the extent that the foot pedal device 4 has been completely brought to "CLOSED state". Therefore, it will be possible to determine whether a sound will be generated under influence of the inertial force of the beater of the foot pedal device 4.

CPU 11 judges whether the shot has been performed, that is, whether the player has pressed the foot pedal device 4 down to the extent that a sound is generated (step S15). When it is determined that the player has not pressed the foot pedal device 4 down (NO at step S15), then, the sound-generation information producing process finishes.

Meanwhile, when it is determined that the player has pressed the foot pedal device 4 down (YES at step S15), CPU 11 advances to step S16.

Depending on the determination made on whether a sound should be generated and the loudness level (velocity) of the sound determined at step S14, CPU 11 produces the sound-generation information (step S16). Then, the sound-generation information producing process finishes. Thereafter, CPU 11 will output sounds based on the produced sound-generation information through the sound source section 19.

The shot detecting process (step S14 in FIG. 5) in the sound-generation information producing process will be described in detail.

Figure 6:
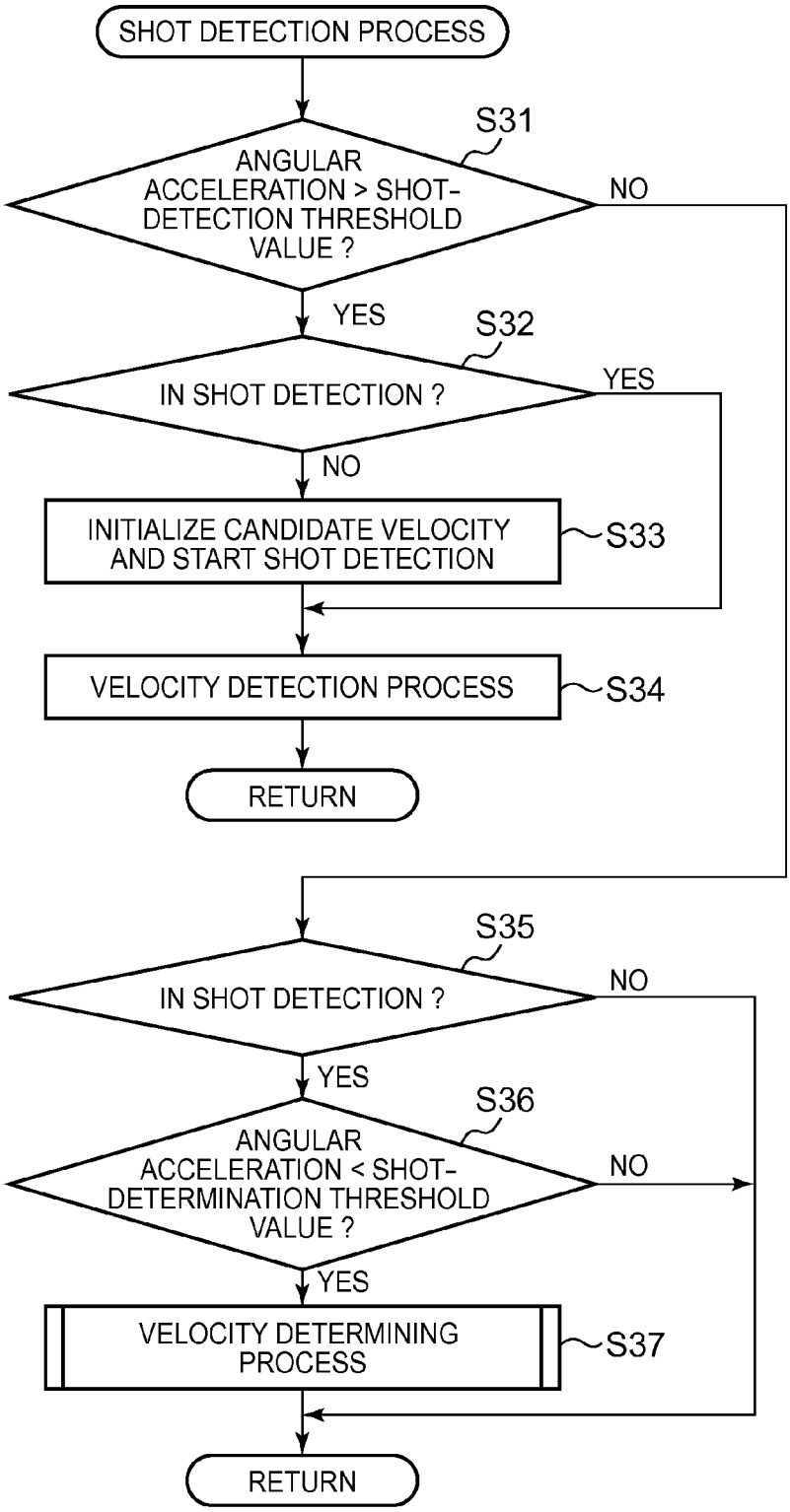
FIG. 6 is a flow chart of a shot detecting process performed in the sound-generation information producing process of FIG. 5.

FIG. 6 is a flow chart showing the detail of the shot detecting process (step S14 in FIG. 5) in the sound-generation information producing process.

The shot detecting process is performed to determine whether a sound should be generated and at what loudness level (velocity) the sound should be generated, based on the obtained angular information.

CPU 11 judges whether the angular acceleration of the foot board 102 is larger than a shot-detection threshold value (step S31).

When it is determined that the angular acceleration of the foot board 102 is not larger than the shot-detection threshold value (NO at step S31), CPU 11 advances to step S35. The process at step S35 will be described later.

Meanwhile, when it is determined that the angular acceleration of the foot board 102 is larger than the shot-detection threshold value (YES at step S31), CPU 11 advances to step S32.

CPU 11 judges whether the operation is in shot detection (step S32). When it is determined that the operation is in shot detection (YES at step S32), CPU 11 advances to step S34.

Meanwhile, when it is determined that the operation is not in shot detection (NO at step S32), CPU 11 advances to step S33.

CPU 11 initializes a candidate of the velocity (candidate velocity), and starts a shot detection (step S33).

CPU 11 performs a velocity detecting process (step S34).

In the velocity detecting process, CPU 11 determines a loudness level (velocity) of a sound to be generated, based on the calculated angular rate, thereby determining a candidate velocity of a sound, which is used for finally determining the loudness level (velocity) of a sound on the basis of the highest angular rate. When one candidate velocity of a sound is determined, CPU 11 obtains another angular information to determine another candidate velocity again, as far as the angular acceleration of the foot board 102 shows a value larger than the shot-detection threshold value. Thereafter, CPU 11 finishes the shot detecting process (step S34) and advances to step S15 in FIG. 5.

Meanwhile, when it is determined that the angular acceleration of the foot board 102 is not larger than the shot-detection threshold value (NO at step S31), CPU 11 advances to step S35.

CPU 11 judges whether the operation is in shot detection (step S35). When it is determined at step S35 that the operation is not in shot detection (NO at step S35), CPU 11 finishes the shot detecting process, and returns to step S15 in FIG. 5.

Meanwhile, when it is determined at step S35 that the operation is in shot detection (YES at step S35), CPU 11 advances to step S36.

CPU 11 judges whether the shot-determination threshold value is larger the angular acceleration of the foot board 102 (step S36). When it is determined at step S36 that the shot-determination threshold value is not larger than the angular acceleration of the foot board 102 (NO at step S36), CPU 11 finishes the shot detecting process, and advances to step S15 in FIG. 5.

Meanwhile, when it is determined at step S36 that the shot-determination threshold value is larger than the angular acceleration of the foot board 102 (YES at step S36), CPU 11 advances to step S37.

CPU 11 performs a velocity determining process (step S37). In the velocity determining process, CPU 11 selects and determines one velocity from among candidate velocities. When the one velocity is determined, CPU 11 finishes the shot detection. The detail of the velocity determining process will be described later. When the velocity determining process (step S37 in FIG. 6) finishes, CPU 11 returns to step S15 in FIG. 5.

Now, the velocity determining process in the shot detecting process shown in FIG. 6 will be described in detail.

Figure 7:
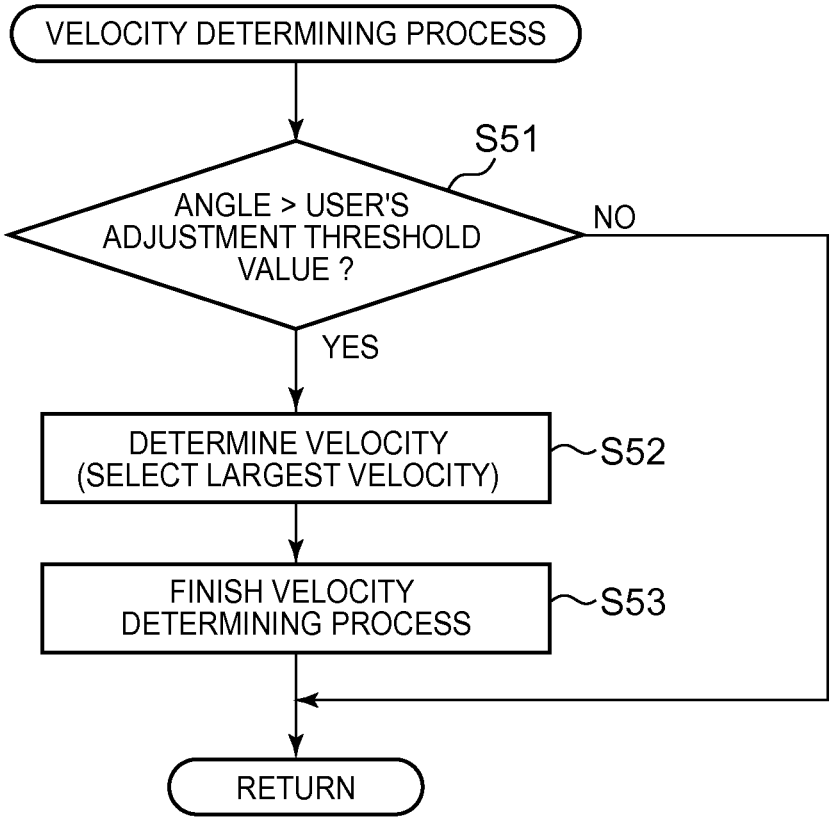
FIG. 7 is a flow chart of a velocity determining process performed in the shot detecting process of FIG. 6.

FIG. 7 is a flow chart of the velocity determining process in the shot detecting process of FIG. 6.

CPU 11 judges whether an angle made between the foot board 102 and the under plate 101 is larger than a user's adjustment threshold value (step S51). When it is determined at step S51 that the angle made between the foot board 102 and the under plate 101 is larger than the user's adjustment threshold value (YES at step S51), CPU 11 advances to step S52.

CPU 11 selects the largest candidate velocity from among the candidate velocities as the loudness level (velocity) of a sound to be generated (step S52). Then, CPU 11 advances to step S53.

Meanwhile, when it is determined at step S51 that the angle made between the foot board 102 and the under plate 101 is not larger than the user's adjustment threshold value (NO at step S51), CPU 11 finishes the velocity determining process.

CPU 11 finishes the shot detection, finishing the velocity determining process (step S53).

As described above, the electronic drum set DS (sound-generation controlling apparatus) according to the present embodiment is provided with the foot board 102, the device for detecting information relating to angles (the potentiometer 108 in the present embodiment), and CPU 11.

The foot board 102 has a structure, which allows the player to press down.

The device (potentiometer 108 in the present embodiment) for detecting information relating to angles is mounted on the foot board 102 and used to detect the angular rate and angular acceleration of the foot board 102, when the foot board 102 has been pressed down by the player.

CPU 11 determined the timing at which the instruction of generating a musical tone is given, based on the angular acceleration detected by the potentiometer 108. Further, CPU 11 controls the instructed generating state of a musical tone, based on the angular rate detected by the potentiometer 108.

As described above, in the electronic drum set DS according to the present embodiment, the player's motion of pressing the foot board 102 down is reflected to the generating state of musical tones, that is, to the contents of the generated musical tones, and therefore the player can give a performance, feeling as if he or she is playing the acoustic drums.

In the electronic drum set DS according to the present embodiment, CPU 11 controls the generating state of the musical tone, thereby adjusting the volume of the musical tone. As described above, the electronic drum set DS according to the present embodiment can output a musical tone, which has a sound volume reflecting the player's motion of pressing the foot board 102 down (the speed and/or force of the player's pressing-down motion), and therefore the player can play the drum set DS, feeling as if he or she is playing the acoustic drums.

In the present embodiment, the device for detecting information relating to angles comprises the potentiometer 108, which obtains the moving distance of the foot board 102 moved by the player's motion of pressing the foot board 102 down to detect the angle made by the foot board 102 and the under plate 101. CPU 11 obtains a variation per unit time of the angle detected by the potentiometer 108 to detect the angular rate. Further, CPU 11 obtains a variation per unit time of the detected angular rate to detect the angular acceleration. In the electronic drum set DS, the angular rate and angular acceleration can be detected with a simple configuration.

It will be understood that the invention is not limited to the particular embodiments described herein, but numerous rearrangements, modifications, and substitutions may be made without departing from the scope of the invention.

In the embodiments described above, the foot pedal device 4, to which the present invention is applied has been described as an example of the foot pedal device of the beater type, but the foot pedal device 4 is not limited to the particular foot pedal device described herein. The foot pedal device 4 can be used as the foot pedal device for the Hi-Hat.

Further, in the embodiments described above, it is determined whether a tone should be generated, based on the angle and angular acceleration of the foot board 102 and also it is determined at what loudness level (velocity) the sound should be generated, based on the angular rate of the foot board 102. But it is possible to construct the foot pedal device 4 such that the tone color of a musical tone to be generated and sound effects of the musical tone are also determined in accordance with the angle, angular rate and angular acceleration of the foot board 102.

In the embodiments described above, the user's adjustment threshold value has been set to the predetermined value so as to place importance on the player's feeling of playing the acoustic drums. But in the case that the user's adjustment threshold value is set close to the limiting value in the plus (+) direction, it will be determined that the angle of the foot board 102 is larger than the user's adjustment threshold value, only when the foot board 102 has been pressed down to the floor.

The series of processes described above can be performed by means of hardware as well as software.

When the series of processes are performed using the software, a program composing such software is installed on the computer and the like through networks and/or recording media. The computer mounted on specialized hardware can be used. The computer can be also used, which has various programs installed on and is capable of performing various functions.

The recording media having the program recorded thereon can be composed of not only the removable recording media 31 (FIG. 1), which are distributed separately from the apparatus body among the users to provide the program, but also recording media previously mounted on the apparatuses to provide the program with users. For instance, the removable medium 31 is composed of a magnetic disk (including a floppy disk), an optical disk, a magnet-optical disk, and so on. For example, the optical disk is composed of CD-ROM (Compact Disk-Read Only Memory), DVD (Digital Versatile Disk), and the magnet-optical disk is composed of MD (Mini-Disk). The recording medium previously mounted on the apparatus to be provided to the user is composed of ROM 12 (FIG. 1) having the program recorded thereon and a hard disk included in RAM 13 (FIG. 1).

In the present description, the steps of writing the program on the recording medium include not only a time series of processes, which are performed in order, but also the processes, which are performed separately or in parallel with each other. Further, in the present description, the terms concerning the system represent apparatuses comprising plural apparatuses and plural methods.

Although specific embodiments of the present invention have been described in the above description, it will be understood that the invention is not limited to the particular embodiments described herein, but numerous rearrangements, modifications, and substitutions may be made to the disclosed embodiments while remaining within the scope of the invention as defined by the following claims and the equivalents thereof.

What is claimed is:

1. A sound-generation controlling apparatus comprising:

a pedal adapted to be pressed down by a user;

an angular data obtaining unit provided on the pedal for obtaining an angular rate and an angular acceleration of the pedal when the pedal has been pressed down by the user;

a sound-generation instructing unit for determining a timing at which an instruction of generating a musical tone is given based on the angular acceleration of the pedal obtained by the angular data obtaining unit; and a sound-generation controlling unit for controlling a sound volume of the musical tone, the generation of which is instructed by the sound-generation instructing unit, based on the angular rate of the pedal obtained by the angular data obtaining unit.

2. The sound-generation controlling apparatus according to claim 1, wherein the angular data obtaining unit comprises:

a potentiometer for obtaining a moving distance of the pedal when the pedal is pressed down by the user to detect an angle of the pedal;

an angular rate obtaining unit for obtaining a variation per unit time of the angle detected by the potentiometer to obtain the angular rate of the pedal; and an angular acceleration obtaining unit for obtaining a variation per unit time of the angular rate of the pedal obtained by the angular rate obtaining unit to obtain the angular acceleration of the pedal.

3. A computer readable non-transitory recording medium having stored thereon a program for controlling a control unit of a sound-generation controlling apparatus, wherein the sound-generation controlling apparatus comprises a computer, a pedal adapted to be pressed down by a user, and an angular data obtaining unit provided on the pedal for obtaining an angular rate and angular acceleration of the pedal caused when the pedal has been pressed down by the user, and wherein the computer program, when executed on the computer, controls the computer to implement a method comprising:

determining a timing at which an instruction of generating a musical tone is given, based on the angular acceleration of the pedal obtained by the angular data obtaining unit; and controlling a sound volume of the musical tone, the generation of which is instructed based on the angular rate of the pedal obtained by the angular data obtaining unit.

4. A method of controlling a sound-generation controlling apparatus, wherein the sound-generation controlling apparatus comprises a pedal adapted to be pressed down by a user, and an angular data obtaining unit provided on the pedal for obtaining an angular rate and angular acceleration of the pedal caused when the pedal has been pressed down by the user, and wherein the method comprises:

determining a timing at which an instruction of generating a musical tone is given, based on the angular acceleration of the pedal obtained by the angular data obtaining unit; and controlling a sound volume of the musical tone, the generation of which is instructed based on the angular rate of the pedal obtained by the angular data obtaining unit.

5. The computer readable non-transitory recording medium according to claim 3, wherein the angular data obtaining unit comprises:

a potentiometer for obtaining a moving distance of the pedal when the pedal is pressed down by the user to detect an angle of the pedal;

an angular rate obtaining unit for obtaining a variation per unit time of the angle detected by the potentiometer to obtain the angular rate of the pedal; and an angular acceleration obtaining unit for obtaining a variation per unit time of the angular rate of the pedal obtained by the angular rate obtaining unit to obtain the angular acceleration of the pedal.

6. The method according to claim 4, wherein the angular data obtaining unit comprises:

a potentiometer for obtaining a moving distance of the pedal when the pedal is pressed down by the user to detect an angle of the pedal;

an angular rate obtaining unit for obtaining a variation per unit time of the angle detected by the potentiometer to obtain the angular rate of the pedal; and an angular acceleration obtaining unit for obtaining a variation per unit time of the angular rate of the pedal obtained by the angular rate obtaining unit to obtain the angular acceleration of the pedal.

7. A sound-generation controlling apparatus comprising:

a pedal adapted to be pressed down by a user;

an angular data obtaining unit provided on the pedal for obtaining an angular rate and an angular acceleration of the pedal when the pedal has been pressed down by the user;

a sound-generation instructing unit for determining a timing at which an instruction of generating a musical tone is given based on the angular acceleration of the pedal obtained by the angular data obtaining unit; and a sound-generation controlling unit for controlling a generating state of the musical tone, the generation of which is instructed by the sound-generation instructing unit, based on the angular rate of the pedal obtained by the angular data obtaining unit;

wherein the angular data obtaining unit comprises:

a potentiometer for obtaining a moving distance of the pedal when the pedal is pressed down by the user to detect an angle of the pedal;

an angular rate obtaining unit for obtaining a variation per unit time of the angle detected by the potentiometer to obtain the angular rate of the pedal; and an angular acceleration obtaining unit for obtaining a variation per unit time of the angular rate of the pedal obtained by the angular rate obtaining unit to obtain the angular acceleration of the pedal.

* * * * *